United States Patent [19]

Frangos

[11] 4,058,233

[45] Nov. 15, 1977

[54] UTENSIL BASKET FOR INSTITUTIONAL DISHWASHING MACHINES

[76] Inventor: John W. Frangos, 2 Brimbal Hill Drive, Beverly, Mass. 01915

[21] Appl. No.: 654,108

[22] Filed: Feb. 2, 1976

Related U.S. Application Data

[63] Continuation-in-part of Ser. No. 425,237, Dec. 13, 1973, Pat. No. 3,935,958.

[51] Int. Cl.[2] ..... B65D 7/20; B65D 85/00; B65D 43/14

[52] U.S. Cl. ..... 220/19; 220/22; 220/23.8; 220/334

[58] Field of Search ..... 220/19, 1 C, 20, 20.5, 220/23.2, 23.4, 23.8, 334, 22; 211/60 R; 99/403, 416; D55/1 E; D49/1 A, 1 C, 1 D; 206/513

[56] References Cited

U.S. PATENT DOCUMENTS

| | | | |
|---|---|---|---|
| 1,660,410 | 2/1928 | Beckman | 220/19 |
| 2,747,388 | 5/1956 | Dolar | 220/334 X |
| 3,050,073 | 8/1962 | McMillan | 220/19 X |
| 3,935,958 | 2/1976 | Frangos | 220/19 |
| D. 202,569 | 10/1965 | Maslow | D49/1 D |

*Primary Examiner*—William Price
*Assistant Examiner*—Steven M. Pollard
*Attorney, Agent, or Firm*—Morse, Altman, Oates & Bello

[57] ABSTRACT

A foraminous basket is provided for use in washing and drying eating utensils in large volume dishwashers such as found in restaurants, institutions and the like. The basket is nestable and formed with one or more compartments for sorting the utensils prior to washing. A detachable cover is provided for closing the compartments and the basket is formed with a flat end wall for standing the basket in an upright washing position. A soaking pan is provided, as well as a decorative casing to allow use of the basket in eating areas. Means are also provided to inhibit tarnishing and reduce polishing of silverware during the soaking and washing procedures.

10 Claims, 17 Drawing Figures

UTENSIL BASKET FOR INSTITUTIONAL DISHWASHING MACHINES

CROSS-REFERENCE TO RELATED APPLICATION

This is a continuation-in-part of U.S. application Ser. No. 425,237, filed Dec. 13, 1973 now U.S. Pat. No. 3,935,958, dated Feb. 3, 1976.

BACKGROUND OF THE INVENTION

1. Field of the Invention

This invention relates generally to dishwashing equipment and more particularly is directed toward a portable basket for presoaking and washing eating utensils in institutional and domestic dishwashing machines.

2. Description of the Prior Art

Large volume dishwashing machines of the sort employed by restaurants, institutions and other eating facilities usually involve a conveyor which carries dishes, pots, pans, utensils, etc., through various washing and drying stages on a continuous or batch basis. While the washing of dishes and similar large objects is generally satisfactory, the washing and handling of eating utensils has not been satisfactory. In practice, washing machines of this type are provided with a number of simple, openwork baskets of plastic, stainless steel mesh or the like in which the utensils are placed in a somewhat random fashion. The baskets are usually carried through the machine in a horizontal position and when they have gone through a washing and drying cycle, the utensils are picked individually from the basket and placed in separate receptacles ready for use. This practice and associated equipment has several drawbacks. First of all, simple, shallow baskets do not support the utensils in a way that insures complete washing and drying of the utensils, particularly if a large number of utensils are in the basket. Secondly, if the utensils have been placed in the basket in a random fashion and subsequently sorted after having been cleaned, excessive handling of the utensils occurs when they are sorted. This, of course, is not desirable from the standpoint of cleanliness and is also time consuming.

Accordingly, it is an object of the present invention to provide a new and improved basket for washing eating utensils in institutional dishwashing machines. Another object of this invention is to provide a utensil basket for large volume dishwashers which provides presorting of the utensils and supports the utensils in an upright position for optimum washing action. A further object of this invention is to provide means for inhibiting tarnishing of silverware as it is being washed.

SUMMARY OF THE INVENTION

This invention features a utensil basket for a domestic, commercial or institutional dishwasher, comprising a foraminous basket formed with a plurality of one or more compartments for presorting utensils when the basket is resting in a horizontal open position. A removable cover is provided on the basket adapted to close the compartments prior to placing the basket in the washing machine. Once the basket is loaded, it is placed in an upright position so that the utensils will be carried vertically through the machine for optimum washing and drying action. Legs on the basket provide drainage clearance whereby a number of baskets may be stacked one upon another for storage and transportation if loaded or nested together if empty.

DETAILED DESCRIPTION OF THE PREFERRED EMBODIMENT

Figure 1:
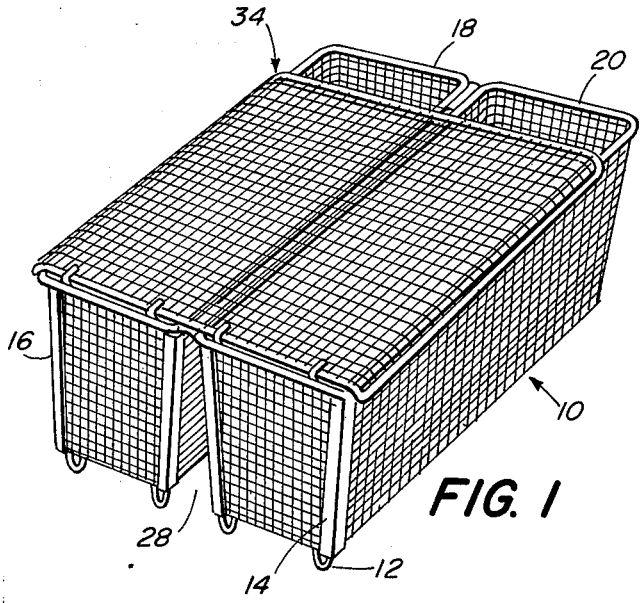
FIG. 1 is a view in perspective of a utensil basket made according to the invention.

Referring now to the drawings, the reference character 10 generally indicates a utensil basket having particular utility in presorting and washing eating utensils in an institutional dishwashing machine. The basket is of openwork construction and may be fabricated from a variety of materials such as stainless steel wire mesh, for example, or it may be molded from a suitable high temperature plastic of foraminous configuration. The basket is portable and typically may be about 12 inches in length, perhaps 11 inches in width, with a depth of perhaps 4 inches. Obviously the dimensions are only by way of example and may be varied as desired. The basket is provided with legs 12 near each corner and each of a length of perhaps 1 inch.

In the illustrated embodiment, the basket is fabricated from stainless steel ¼ inch square mesh and includes a frame formed by struts 14 and cross-pieces 16 welded or otherwise joined to the basket. The basket of the illustrated embodiment is formed with two adjacent compartments 18 and 20 adapted to hold forks, knives, teaspoons, soup spoons, etc. Each compartment typically is perhaps 4 inches wide and otherwise extends the length and depth of the basket. The compartments are open at their upper ends when the basket is in the horizontal loading position of FIG. 2. Each compartment is formed by side walls 22 and 24 which taper towards a rounded bottom wall 26 to define a wedge-shaped clearance 28 between adjacent compartments. The compartment walls preferably are of the same construction which, in the illustrated embodiment, is an open mesh stainless steel to allow water jets to pass freely through the basket for maximum washing action. The wedge-shaped clearance between adjacent baskets further enhances the movement of water jets amongst the utensils and also aids in the circulation of the drying air during the drying cycle of the machine. The rounded bottom walls 26 facilitate removal of the utensils from the individual compartments after the utensils have been washed and dried.

Figure 4:
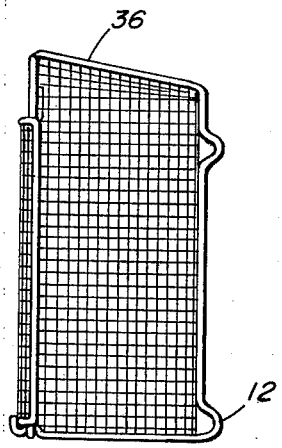
FIG. 4 is a view in side elevation showing the basket in a washing position.
Figure 5:
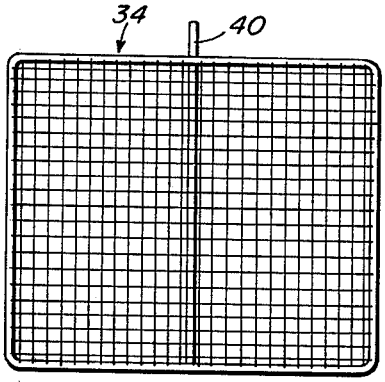
FIG. 5 is a top plan view of the cover only.

Preferably the basket is fabricated from a stainless steel square mesh material in which the mesh size is approximately ¼ inch. The relatively small mesh and square openings of such material serves to retain all common eating utensils that may be placed in the basket for washing, including thin, narrow items such as shrimp forks and drink stirrers. The side walls 22 and 24 of each compartment, as well as each top wall 30 converge slightly towards one another, while a base wall 32 is substantially perpendicular to the bottom wall 26, whereby the basket may be stood on end as suggested in FIG. 4 during the washing and drying operations.

The basket is loaded in the horizontal position resting on its legs 12. The utensils are placed flat down within the individual compartments and, when loaded, a cover 34 is connected over the open front of the basket. The basket may then be stood on end as in FIG. 4. The silverware, in an upright position, is washed better than would be the case if the basket were lying flat with utensils lying one on top of the other.

Figure 13:
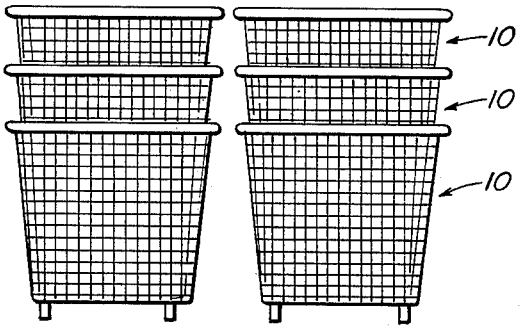
FIG. 13 is a view in end elevation showing a plurality of stacked and nested baskets.

By fabricating the baskets with tapered walls, it is possible to nest baskets one within another, as suggested in FIG. 13, thereby minimizing storage requirements. Obviously, when nesting stacked baskets the covers are removed.

The utensil basket is formed with a frame 36 that extends about the edges and corners of the basket to provide rigidity thereto. Typically, the frame may comprise heavy stock stainless steel wire, or relatively thin strip material, welded or otherwise bonded to the mesh material.

Figure 2:
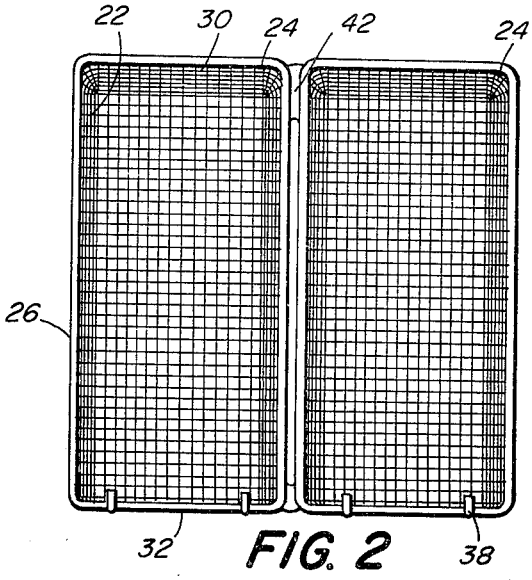
FIG. 2 is a top plan view thereof with the cover removed.
Figure 7:
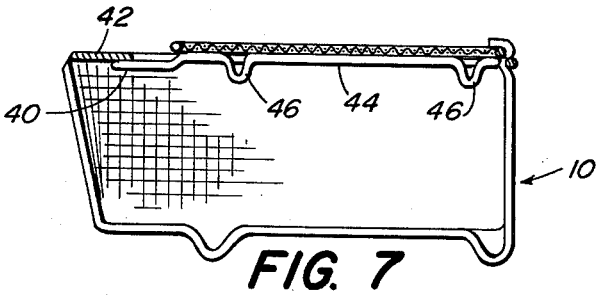
FIG. 7 is a cross-sectional view taken along the line 7—7 of FIG. 3.

The cover 34 is fully removable from the basket and may be detachably connected thereto by various means. In the illustrated embodiment, the cover is held in place by means of hooks or prongs 38 located along the lower edge of the basket at the front thereof and adapted to receive the lower edge of the cover 34 and hold it against displacement. The cover 34, in turn, is provided with an offset finger 40 adapted to pass in behind and engage a fillet 42 extending between adjacent baskets at the upper end thereof, as best shown in FIGS. 2 and 7. The cover is positioned by tipping the upper edge of the cover so that the finger moves in behind the fillet and then moving the cover flat against the top or front of the basket so that it lies flat against the frame, with the lower edge being clear of the hooks 38. Once flat against the frame, the cover is slid down perhaps ½ inch or so, so that the lower edge of the cover locks in behind the hooks.

Figure 6:
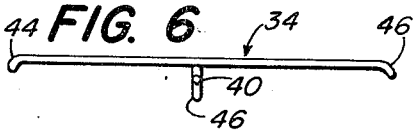
FIG. 6 is an end view thereof.
Figure 3:
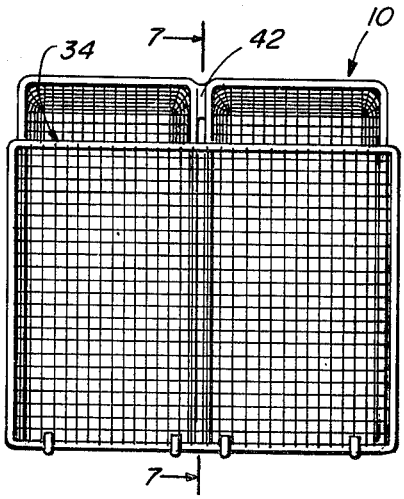
FIG. 3 is a view similar to FIG. 2 but showing the basket with the cover in place.

In order to form a better fit between the cover and the outer edges of the basket, the side margins of the cover are bent inwardly to a slight extent, as best shown in FIG. 6, to form return bends 44 and 46 which curve in and around the sides of the basket, thereby preventing small utensils from accidentally coming out of the basket when the basket is upright.

It will be noted that the cover 34 is slightly shorter than the overall length of the basket so that the upper part of the basket is open at its front. This arrangement has two primary advantages; one being the formation of a hand hole by means of which personnel may easily pick up the unit in an upright position by merely inserting several fingers within the opening formed between the top of the basket and the top edge of the cover. This eliminates the need of a separate handle. Secondly, the opening enhances the washing action since it provides an uninhibited path for water jets coming in through the opening.

Figure 8:
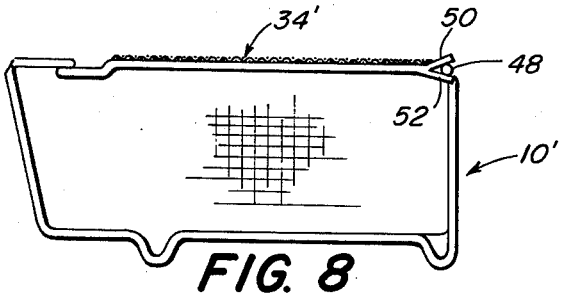
FIG. 8 is a view similar to FIG. 7 but showing a modified cover lock.

It will be noted in FIGS. 7 and 8 that the feet 12 are so located and spaced that they will rest within the area of the cover when the cover is in position. In this fashion the baskets may be stacked one upon another with the feet of one basket resting upon a cover of the basket beneath it. The feet, of course, keep the basket raised when horizontal, enhancing drainage and preventing the utensils from getting dirty or wet after washing and drying.

The finger 40 of the cover 34, in the illustrated embodiment, is an extension of a center bar 44 formed on the inside face of the cover and extending along the center thereof. The center bar is formed with one or more bends 46 which extend into the gap between adjacent sections as a means for stabilizing the cover and centering it with respect to the basket. Additional fingers may be provided to increase the locking action, if desired.

Figure 9:
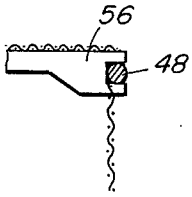
FIGS. 9 and 10 are detail sectional views showing further modifications of the cover lock.

Instead of the use of the hooked prongs 38 of the principal embodiment, the cover may be detachably connected to the basket by other means which will eliminate the use of the hooks. For example, in the FIG. 8 embodiment, a basket 10' is provided of a configuration similar to that of the principal embodiment, with the exception that the hook members are eliminated, and in place thereof is a simple rib 48 extending about the edge of the basket opening. A cover 34' is provided which is also similar to the cover 34 of the principal embodiment with the exception that the lower edge of the cover is formed with two or more spaced pairs of diverging fingers 50 and 52 adapted to engage opposite sides of the rib 48, thereby locking the cover in place. Other means may also be used. For example, in FIG. 9, the cover is provided with one or more tabs 56 formed with a bifurcated end portion adapted to slip over the rib 48 of the basket, while in FIG. 10 the cover is formed with an offset slotted tab 58 which fits in under the rib 48 to interlock with the mesh of the basket. The tab 58 of FIG. 10 is also shown in the fragmentary plan view of FIG. 11.

Figure 10:
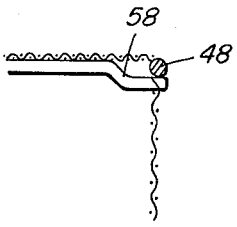
Figure 11:
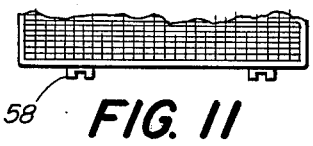
FIG. 11 is a detail top plan view showing yet another modification of the cover lock.
Figure 12:
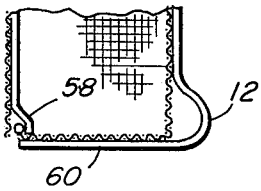
FIG. 12 is a detail sectional side view showing a modified cover lock in operating position.

When utilizing the locking configurations of FIGS. 8 through 11, and especially with respect to FIG. 10, the end wall on the basket, on which the basket rests when in an upright position, should be raised slightly so that the lower end of the cover is not dislodged from its locking position by the surface on which the basket is resting. This may be achieved by means of framing ribs 60, which extend down the end of the basket to form the legs 12, as best shown in FIG. 12. With the ribs 60 on the outside of the basket along this wall, they will provide a shim effect to maintain the end of the basket away from the supporting surface and also to keep the lower edge of the cover out of contact with the supporting surface.

Figure 14:
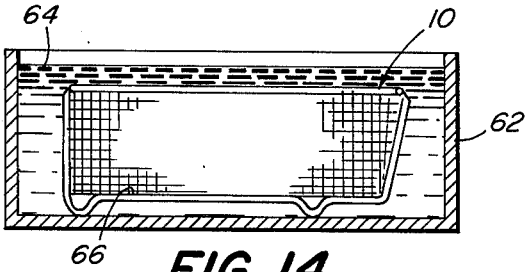
FIG. 14 is a sectional view in side elevation of a basket in a prewashing soak pan.

In institutional dishwashing operations it is common practice to presoak the silverware in water prior to running through the dishwasher. The presoaking stage loosens the food that may be present on the surface of the utensils and greatly enhances the effects of the washing machine. Normally the silverware is placed in a simple pan filled with water and, after soaking, it is transferred to a basket which is placed in the washing machine. However, in the present invention, the utensil basket 10 which holds the silverware may be placed in a soaking pan 62, as shown in FIG. 14, and then the basket may be transferred to the washing machine without shifting the silverware. The soaking pan 62 is relatively shallow and has a height slightly in excess of the depth of the basket 10 in order to fully cover the silverware and the basket immersed therein. The pan may contain a quantity of water 64 which may include presoaking solutions which help loosen or soften food particles adhering to the silverware.

It has been found that the cleaning of silverware, whether silver plate or solid silver, may be further enhanced by introducing aluminum in some form in the soaking stage of the cleaning operation. Aluminum within the soaking stage has been found to inhibit the formation of tarnish on the silver and with regular use will maintain the silverware clean and bright. Preferably the aluminum is introduced by way of a liner 66 of aluminum foil placed on the bottom of the basket where it may contact the silverware and be most effective in the detarnishment action. The effect is further enhanced by adding to the soaking solution a small quantity of sodium metaborate.

Figure 15:
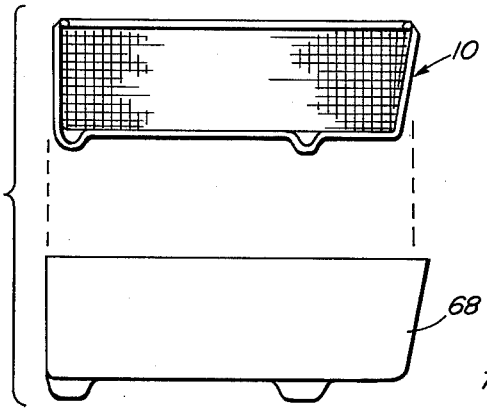
FIG. 15 is a view in side elevation of a basket and removable decorative casing.
Figure 16:
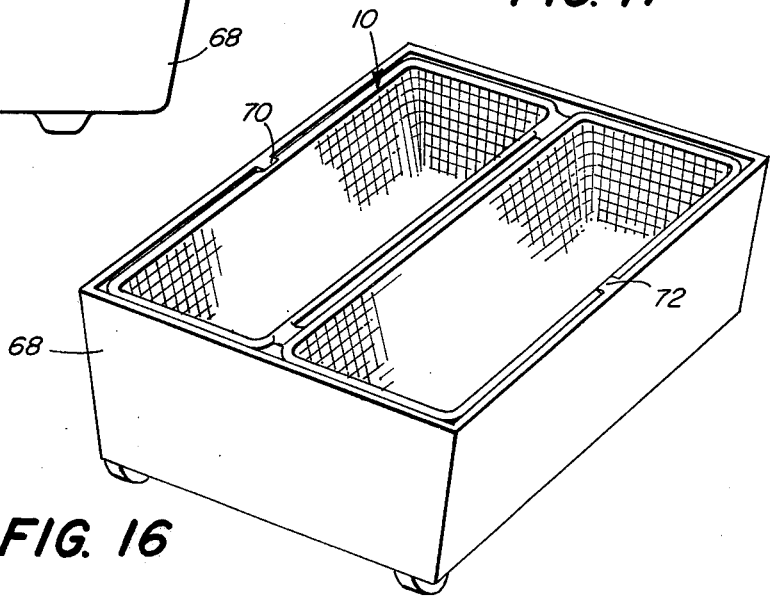
FIG. 16 is a perspective view of the parts shown in FIG. 15, and, FIG. 17 is a perspective view of a basket with a removable divider.

Referring now to FIGS. 15 and 16, there is illustrated a modification of the invention and, in this embodiment, the utensil basket 10 is provided with a detachable, decorative outer case 68 which fits over the outside of the basket 10 and has an opening at the top providing access to the several compartments. The case 68 generally corresponds in size and shape with the basket 10 but is imperforate and typically may be molded from plastic in a suitable decorative finish consistent with the decor of a restaurant. Plain colors or wood grain finishes, for example, may be provided. The function of the casing 68 is to enclose the basket so that it may be used in an eating area of a restaurant without disrupting the decor and also to prevent the basket from dripping while in the eating area. Thus, clean utensils may be carried into an eating area and set on a counter for access by waitresses, and busboys may use the same unit for collecting soiled utensils and then return the basket and the casing back to the kitchen where they may be separated. The casing 68, in the illustrated embodiment, is provided with a pair of tabs 70 and 72 extending inwardly from the top edges thereof to engage the edge of the basket. The basket may be removed by merely flexing the side walls of the casing slightly outward to release the tabs and then removing the basket.

Figure 17:
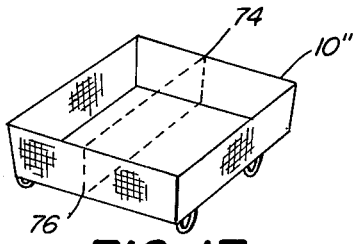

Referring now to FIG. 17, there is illustrated a further modification of the invention, and in this embodiment a basket 10″ is formed with a single compartment which may be formed into multiple compartments by means of a detachable panel 74 placed selectively within the basket. The panel 74 is provided with prongs 76 at the ends thereof to lock into the mesh of the basket. The panel is set in place and removed by bending it slightly in order to engage and disengage the prongs.

Baskets of this type are suited for domestic or commercial dishwashers. With commercial equipment, a single rack or cradle can carry perhaps four baskets in an upright position through the dishwasher on its conveyor.

Having thus described the invention, what I claim and desire to obtain by Letters Patent of the U.S. is:

1. Apparatus for use in washing eating utensils and the like, comprising a. a two-position foraminous basket formed with at least one generally rectangular compartment open to the front of said basket when said basket is in an upright vertical position for receiving utensils placed therein when said basket is in a horizontal position, the length of said compartment being greater than the length of said utensils, b. foraminous partial cover means detachably connected to said basket across the front of said compartment, and, c. locking means, including fingers extending from the edges of said cover means and adapted to pass through the walls of said basket for securing said cover means to said basket, d. said basket being formed with a back wall and at least one side wall substantially perpendicular to one another whereby said basket may be placed on said back wall in a horizontal position for loading and unloading said compartment and in an upright position on said one side wall for washing with said cover means in place, e. said basket including a plurality of legs extending substantially perpendicularly from said back wall within an area spanned by said cover means.

2. Apparatus, according to claim 1, wherein said basket and cover means are formed of a mesh material substantially ¼ inch square.

3. Apparatus, according to claim 1, wherein said cover means includes a flat center portion spanning said compartment and rearwardly extending lips along opposite side edges.

4. Apparatus, according to claim 1, wherein the back wall of said basket is formed with a plurality of troughs defining a plurality of compartments, the walls of adjacent troughs diverging from one another towards the back of said basket to form wedge-shaped voids therebetween whereby one basket may be nested into another similar basket.

5. Apparatus, according to claim 1, including at least one detachable panel connected to said basket to form a plurality of compartments within said basket.

6. Apparatus, according to claim 1, in combination with an imperforate outer case detachably connected to said basket and generally conforming to the outer walls thereof.

7. Apparatus, according to claim 1, wherein at least two of said legs are substantially co-planar with said one side wall to stabilize said basket when in an upright position.

8. Apparatus, according to claim 1, in combination with a soaking pan adapted to contain a quantity of soaking liquid to a depth sufficient to cover a basket immersed horizontally therein.

9. Apparatus, according to claim 8 wherein said liquid includes a solution of water and sodium metaborate in combination with an aluminum material immersed therein.

10. Apparatus, according to claim 9, wherein said aluminum material is in the form of foil.

* * * * *